United States Patent [19]

McCoy

[11] 4,384,950

[45] May 24, 1983

[54] DEMULSIFICATION OF BITUMEN EMULSIONS USING BRANCHED WATER SOLUBLE QUATERNARY AMMONIUM-CONTAINING POLYMERS

[75] Inventor: David R. McCoy, Austin, Tex.

[73] Assignee: Texaco Inc., White Plains, N.Y.

[21] Appl. No.: 326,453

[22] Filed: Dec. 2, 1981

[51] Int. Cl.[3] ..... C10G 33/04

[52] U.S. Cl. ..... 208/188; 208/188; 208/193; 252/358; 210/708; 210/732; 210/735; 210/736; 210/737; 564/193; 528/366

[58] Field of Search ..... 208/188, 193, 708, 732, 208/735, 736, 737; 252/358; 564/193

[56] References Cited

U.S. PATENT DOCUMENTS

| | | | |
|---|---|---|---|
| 2,838,397 | 6/1953 | Grunfest et al. | 162/168.7 |
| 2,926,154 | 2/1960 | Kleim | 162/164.3 |
| 3,014,896 | 12/1961 | Colwell et al. | 210/734 |
| 3,171,805 | 3/1965 | Suen et al. | 210/734 |
| 3,224,990 | 12/1965 | Babcock | 162/164.3 |
| 3,240,664 | 3/1966 | Earle, Jr. | 162/164.3 |
| 3,661,868 | 5/1972 | Barron | 210/734 |
| 3,689,468 | 9/1972 | Cenci et al. | 210/735 |
| 3,951,921 | 4/1976 | Espy et al. | 210/735 |
| 4,209,422 | 6/1980 | Zimmerman et al. | 252/358 |
| 4,256,665 | 3/1981 | McEntire | 564/135 |
| 4,256,666 | 3/1981 | McEntire | 564/135 |
| 4,259,259 | 3/1981 | McEntire | 564/137 |

*Primary Examiner*—Delbert E. Gantz
*Assistant Examiner*—Helane E. Maull
*Attorney, Agent, or Firm*—Carl G. Ries; Jack H. Park; Kenneth R. Priem

[57] ABSTRACT

A process for recovering bitumen from oil-in-water (o/w) emulsions is disclosed wherein water soluble demulsifiers are used. These demulsifiers are branched water-soluble quaternary ammonium-containing polymers. To resolve the bituminous petroleum emulsions, the process is carried out between 25° and 160° C. wherein the demulsifier of the invention is contacted with the bituminous emulsion.

4 Claims, No Drawings

DEMULSIFICATION OF BITUMEN EMULSIONS USING BRANCHED WATER SOLUBLE QUATERNARY AMMONIUM-CONTAINING POLYMERS

BACKGROUND OF THE INVENTION

1. Field of the Invention

This invention is concerned with the breaking or resolution of oil-in-water (o/w) bituminous emulsions by treatment with quaternary ammonium-containing polymers.

2. Description of the Related Art

A great volume of hydrocarbons exist in known deposits of tar sands. These deposits occur at various places, the Athabasca tar sands in Canada being an example. The petroleum in a tar sand deposit is an asphaltic bitumen of a highly viscous nature ranging from a liquid to a semi-solid. These bituminous hydrocarbons are usually characterized by being very viscous or even non-flowable under reservoir conditions by the application of driving fluid pressure.

Where surface mining is not feasible, the bitumen must be recovered by rendering the tar material mobile in-situ and producing it through a well penetrating the tar sand deposit. These in-situ methods of recovery include thermal, both steam and in-situ combustion and solvent techniques. Where steam or hot water methods are used, a problem results which aggravates the recovery of the bitumen. The difficulty encountered is emulsions produced by the in-situ operations. These emulsions are highly stable O/W emulsions which are made even more stable by the usual presence of clays. Most *liquid* petroleum emulsions are water-in-oil (W/O) types. These normal W/O emulsions are broken by methods known in the art. However, the bitumen emulsions which are O/W types present a much different problem, and the same demulsifiers used in W/O emulsions will not resolve the O/W bitumen emulsions.

C. W. W. Gewers, *J. Canad. Petrol. Tech.*, 7(2), 85–90 (1968) describes the uniqueness of emulsions encountered in the production of bitumen from tar sands.

Application Ser. No. 326,462 filed of even date describes demulsification of bitumen using reaction products of diepoxides with polyoxyalkylene diprimary amines.

Application Ser. No. 326,454 filed of even date describes polymers prepared from the reaction of polyoxyalkylene diprimary amines with epichlorohydrin.

Application Ser. No. 326,459 filed of even date describes demulsification using ionenes from ditertiary amines and dihalo compounds. The products of the present invention are distinguished from those of this application by being prepared from a ditertiary amine containing a secondary amine functionality. This difference gives rise to higher molecular weight crosslinked products containing substantial amounts of non-quaternary amine groups.

SUMMARY OF THE INVENTION

The invention is a method for recovering petroleum from O/W bitumen emulsions by resolving or breaking (demulsifying) these emulsions by contacting the emulsions at a temperature of from between about 25° and 160° C. with branched water soluble quaternary ammonium-containing polymers prepared by the reaction of (a) comprising a component which is a $\beta$-aminopropionamide of the general formula

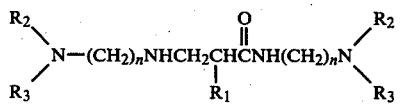

wherein $R_1$ is hydrogen or $CH_3$, n=2–6 and $R_2$ and $R_3$ taken separately are hydrogen or lower alkyl, or $R_2$ and $R_3$ taken jointly are combined with nitrogen to form a heterocyclic group consisting of morpholine, pyrrolidine and piperidine. Component (a) may be either substantially as depicted in the formula above or may contain up to 20% impurities arising from the process of manufacture. For example, the above compounds may be prepared by reaction of

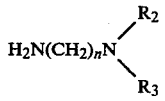

with

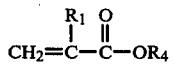

wherein $R_4$ is lower alkyl or H. The products of any of the above reactions are substantially the $\beta$-aminopropionamide shown above with lesser amounts of compounds of the structures

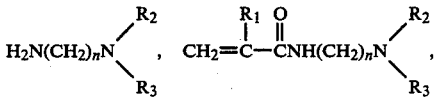

for example. Typical preparation methods are disclosed in U.S. Pat. Nos. 4,256,665, 4,256,666 and 4,259,259 which are incorporated herein by reference.

(b) reactive difunctional reagents of the type X—$R_5$–Y where X and Y=halo or epoxy groups, and $R_5$=aromatic, aliphatic or olefinic groups which may optionally contain ether groups. The reaction of (a) and (b) takes place neat or in the presence of an inert solvent between about 20 ° to 150° C. at atmospheric pressure in mole ratios of (a):(b) ranging from 0.5:1 to 2:1 so as to obtain polymers of >4,000 molecular weight containing ≧3 meq/g total amines. These polymers are also characterized by the presence of 15 to 80% of quaternary ammonium salts based on total amine.

The above polymers may be utilized in a chemical demulsification process as is or after adding to the polymer enough inorganic or organic acid to render a 1% aqueous solution pH <7. The invention is also the polymer as a composition of matter.

DESCRIPTION OF THE PREFERRED EMBODIMENTS

Especially useful in the process of the present invention are polymers wherein compound (b) is epichlorohydrin or 1,4-dichloro-2-butene.

Reactant (a) is especially preferred to be as depicted in the Summary of the Invention with n=3 and $R_2=R_3=CH_3$ or $CH_2CH_3$.

The produced bitumen emulsions may be treated by the process of our invention in a conventional manner, for example, in a conventional horizontal treater operated, for example, from about 25° to 160° C. and, preferably, from about 50°-150° C. at autogenous pressures. The concentration of the chemical demulsifier described above used in treating the bitumen in water emulsions may range from about 1 to 200 parts per million and, preferably, from about 10 to 150 parts per million with the optional addition of an organic diluent and/or inorganic salt as well as standard flocculants and mechanical or electrical means of demulsification.

The following examples describe more fully the present process. However, these examples are given for illustration and are not intended to limit the invention.

EXAMPLE I

Amide-Dichlorobutene Polymer

A 250 ml flask was charged with 50 g of water and 12.5 g of the propionamide with structure (a) where $R_1=R_2=R_3=CH_3$, n=3. The crude charge contained 7.3 wt. % dimethylaminopropylmethacrylamide by liquid chromatographic analysis and was made by the condensation of dimethylaminopropylamine with methacrylic acid.

The reaction mixture was heated to 100° C. under nitrogen atmosphere with mechanical stirring and then charged over a 45 minute period with 7.5 g of 1,4-dichloro-2-trans-butene. After addition was complete, 150 g of water was added to dissolve the gel formed. The product solution* was analyzed to contain 0.25 meq/g total amine (0.03 free, 0.14 amine hydrochloride and 0.08 quats). Liquid chromatographic analysis over a diquarternary ammonium-modified size exclusion silica column showed 17.2 area percent 140,000 molecular weight product, 63.6% at 16,000 and 19.2% at 7,000.

*Insoluble gel removed from product solution before analysis.

EXAMPLE II

Amide-Dichloroethane Polymer

A 250 ml flask was charged with 50 g ethylene glycol and 25.8 g of the amide of Example I. The mixture was heated to 110° C. under nitrogen atmosphere with magnetic stirring and then charged over one-half hour at 110°-125° C. with 15 g of 1,2-dichloroethane. The mixture was digested for 2 hours further at 110° C. Product analyzed for 3.28 meq/g total amine (1.56 free, 0.94 amine hydrochloride and 0.78 quats) with liquid chromatographic analysis showing 52.9% of polymer at 6,000 molecular weight and remainder at approximately 1,000.

EXAMPLE III

Repeat of Example I Without Gel Formation

Method of Example I was repeated with following variations: (a) all water added at beginning of reaction, (b) 8 g dichlorobutene added over 110 minutes at 80° C., (c) final reflux of reaction mixture for one hour. Product had 0.65 meq/g amine (0.07 free, 0.18 amine hydrochloride, 0.4 quats) with an average molecular weight of 13,500 by liquid chromatographic analysis.

EXAMPLE IV

Preparation of Amide-Epichlorohydrin Polymer

A 500 ml flask was charged with 100 g of water and 51.6 g of the amide of Example I. The mixture was heated for one-half hour at 55° C. and then for one hour at 80° C. The reaction solution contained 3.52 meq/g total amine (2.84 free, 0.68 quats) and the polymer had an average molecular weight of 6,600 by liquid chromatographic analysis.

EXAMPLE V

Repeat of Example IV Using One Mole Epichlorohydrin

The procedure of Example IV was repeated with 200 g of water and 15.6 ml epichlorohydrin added over a 50 minute period. The product solution contained 1.99 meq/g total amine (1.23 free, 0.76 quats).

EXAMPLE VI

Repeat of Example IV Using 1.5 Moles Epichlorohydrin

The procedure of Example V was repeated using 23.4 ml of epichlorohydrin. The product solution contained insoluble gel which was removed prior to analysis. Solution analyzed for 1.89 meq/g total amine (0.88 free, 1.01 quats).

EXAMPLE VII

Polymer from Propionamide with $R_1=H$

A sample of crude propionamide prepared by reaction of acrylic acid with dimethylaminopropylamine (DMAPA) was stripped at 140° C./3 mm Hg pressure until no further overhead was obtained and nuclear magnetic resonance of the residue showed no detectable DMAPA or dimethylaminopropylacrylamide. The distillation residue (crude propionamide of structure (a) where $R_1=H$, $R_2=R_3=CH_3$, n=3) was charged (48.8 g) along with 200 g of water to a 500 ml flask and then reacted with 15.6 ml of epichlorohydrin as in Example V above to obtain a product solution analyzing for 2.28 meq/g total amine (1.45 free, 0.13 amine hydrochloride and 0.7 quats).

EXAMPLE VIII

Demulsifier Testing

The following basic testing procedure was employed:

a. A 1 weight percent aqueous solution (on an amines charged basis where aminopolymers were used, rather than on an amines salts basis) of each chemical was prepared with pH adjustment accomplished by use of concentrated hydrochloric acid.

b. A 30 ml PYREX® test tube equipped with screw top was charged with 23 ml emulsion of 11.5 weight percent bitumen content obtained by in-situ steam flooding in tar sand pattern located at Ft. McMurray, Alberta, Canada.

c. 2 ml Wizard Lake crude oil was added as diluent and the contents of the test tube were mixed.

d. The contents of the test tube were equilibrated in a 80° C. oven for 1-2 hours and mixed again.

e. Chemical was added to the hot, dilute emulsion at 120 ppm treating level.

f. Contents of the test tubes were mixed, re-equilibrated in an oven at 80° C. for 1 hour and mixed again.

g. After 20 hours of standing at 80° C., measurements were made on the volume of top and middle layers, and the appearance of the aqueous phase was noted. Samples of some top layers were carefully removed by pipetting and subjected to Karl-Fischer analysis for determination of the water content. pH measurements were made on the aqueous phases of some broken emulsions to confirm that the addition of even highly acidic demulsifier solutions in the small quantities used have little effect on lowering the pH from the initially observed emulsion pH of 7.8.

Results of the testing are summarized in the following table with POLYOX ® WSR-301 [4 million molecular weight poly(ethylene oxide)] as a standard.

Operable examples are given with various amides, difunctional reagents and reagent mole ratios as well as use and non-use of added acid to the organic demulsifier prior to addition to emulsion. One inoperable example is also included showing the effect of polymers with too low a molecular weight (VIIIb).

DEMULSIFIER TESTING

| Example VIII | Candidate Demulsifier | Concentration (ppm) | Oil Phase Vol. in ml (% $H_2O$) | Emulsion Phase Vol. in ml (% $H_2O$) | Aqueous Phase Appearance |
|---|---|---|---|---|---|
| a | Product of Ex. I | 120 | 10 (34.9) | None | Yellow, cloudy |
| b | Product of Ex. II* | 120 | 1.2 | 7.2 | Muddy with solids present |
| c | POLYOX WSR-301 | 120 | 6.2 (58.4) | 1.4 | Dark, translucent |
| d | None | — | 2.2 | 2.6 | Muddy |
| e | Product of Ex. III | 120 | 8.4 (24.6) | None | Yellow, translucent |
| f | Product of Ex. IV | 120 | 8.4 (10.8) | None | Yellow, hazy |
| g | POLYOX WSR-301 | 120 | 10 (55.9) | 1 | Yellow, translucent |
| h | None | — | 4.8 | 2.6 | Muddy |
| i | Product of Ex. V* | 120 | 7.4 (15.9) | None | Light yellow, clear |
| j | POLYOX WSR-301 | 120 | 7 (89.1) | 2.2 | Translucent |
| k | None | — | 5.5 | 1.2 | Muddy |
| l | Product of Ex. VI* | 120 | 10.1 (5.62) | None | Yellow, clear |
| m | Product of Ex. VII* | 120 | 10.8 (21.4) | None | Light yellow, clear |
| n | POLYOX WSR-301 | 120 | 11 (54.3) | 1.9 | Translucent |
| o | None | — | 6 | 1.9 | Muddy |

*Enough concentrated hydrochloric acid added to demulsifier to render a 1% aqueous solution >pH 7 prior to use.
Note:
Horizontal lines separate runs made on same day with same emulsion.

I claim:

1. A process for recovering petroleum from O/W bitumen emulsions by demulsifying said emulsions comprising contacting the emulsions at a temperature of from between about 25° and 160° C. with branched water soluble quaternary ammonium-containing polymers of >4,000 molecular weight containing ≧3 meq/g total amines prepared by the reaction of (a) A component comprising β-aminopropionamides of the general formula

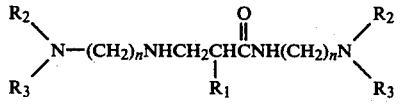

wherein $R_1$ is hydrogen or $CH_3$, n=2–6 and $R_2$ and $R_3$ taken separately are hydrogen or lower alkyl, or $R_2$ and $R_3$ taken jointly are combined with nitrogen to form a heterocyclic group, and (b) 0.5–2.0 moles per mole of (a) reactive difunctional reagents of the type X—$R_5$—Y where X and Y=-halo or epoxy groups, and $R_5$=aromatic, aliphatic or olefinic groups.

2. A process as in claim 1 wherein component (b) is epichlorohydrin.

3. A process as in claim 1 wherein (b) is 1,4-dichloro-2-butene.

4. A process as in claim 1 wherein n=3 and $R_2=R_3=CH_3$ or $CH_2CH_3$.

* * * * *